United States Patent [19]

Mitchell

[11] 4,190,205

[45] Feb. 26, 1980

[54] ROAD MARKING APPARATUS AND METHOD

[75] Inventor: Wayne R. Mitchell, Muncy, Pa.

[73] Assignee: Prismo Universal Corporation, Montgomery, Pa.

[21] Appl. No.: 949,420

[22] Filed: Oct. 3, 1978

[51] Int. Cl.[2] ..... B05B 1/24

[52] U.S. Cl. ..... 239/129; 126/19.5; 239/130

[58] Field of Search ..... 404/94; 239/128-130, 239/135; 427/136-138; 126/19.5

[56] References Cited

U.S. PATENT DOCUMENTS

| | | | |
|---|---|---|---|
| 2,134,799 | 11/1938 | Pass | 239/135 X |
| 2,903,189 | 9/1959 | Patton | 239/120 |
| 2,980,339 | 4/1961 | Bok et al. | 239/135 |
| 3,092,325 | 6/1963 | Brown, Jr. et al. | 239/129 X |
| 3,219,027 | 11/1965 | Roche | 239/129 X |
| 3,474,057 | 10/1969 | de Vries | 260/42.47 X |
| 3,802,396 | 4/1974 | Currie | 239/135 X |

*Primary Examiner*—Bruce H. Stoner, Jr.
*Assistant Examiner*—Andres Kashnikow
*Attorney, Agent, or Firm*—Cushman, Darby & Cushman

[57] ABSTRACT

The apparatus provides an internal means for spraying and heating quick drying traffic paint to a minimum temperature of 120° F. utilizing a primary heat collector within which engine liquid is in thermal communication with engine exhaust gases and heated compressed air. Such heated engine liquid is then used as a heat transfer medium to elevate the temperature of quick drying traffic paint within a shell and tube heat exchanger.

7 Claims, 1 Drawing Figure

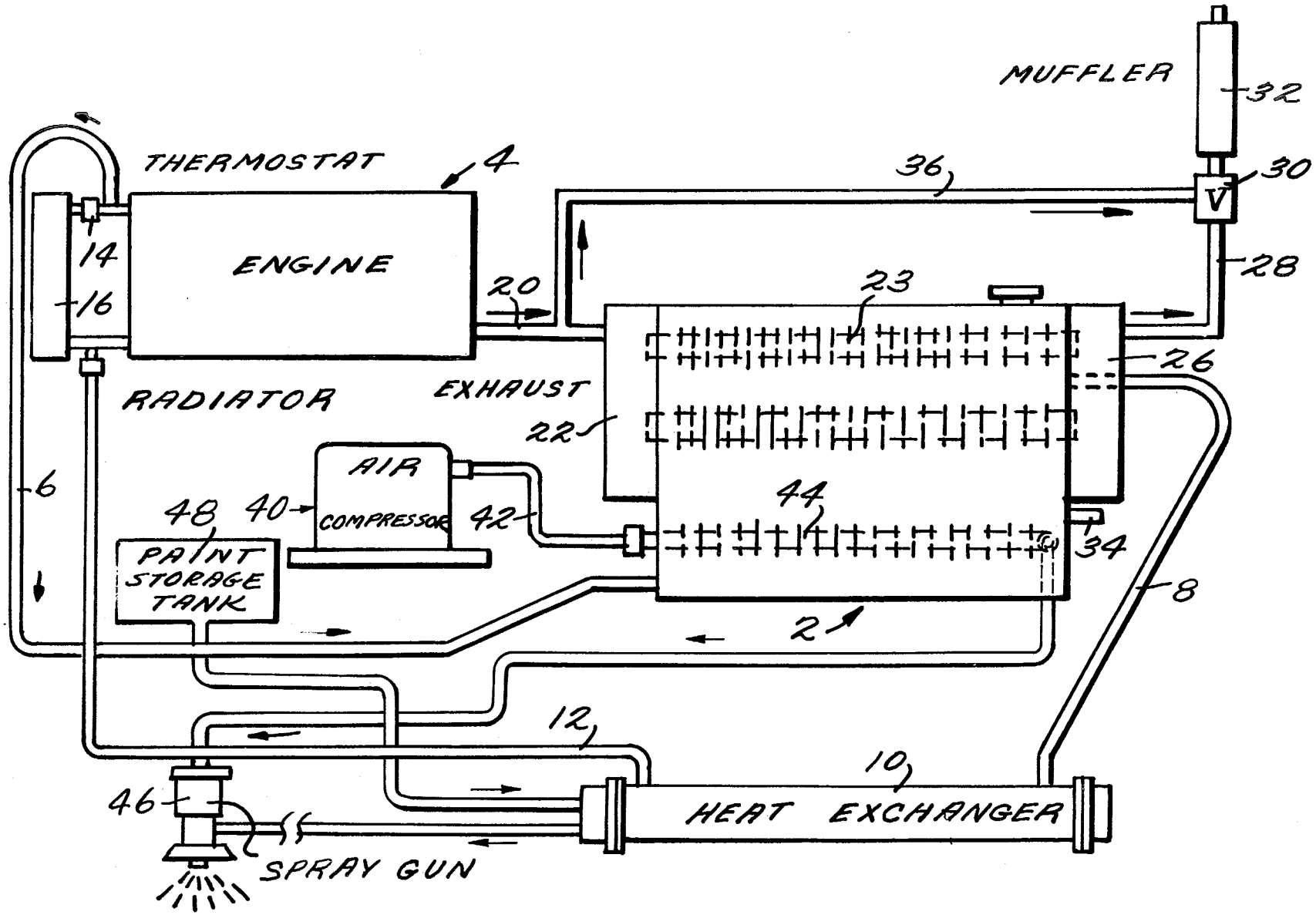
MUFFLER
THERMOSTAT
ENGINE
RADIATOR
EXHAUST
AIR
COMPRESSOR
PAINT STORAGE TANK
HEAT EXCHANGER
SPRAY GUN
2
4
6
8
10
12
14
16
20
22
23
26
28
30
32
34
36
40
42
44
46
48

ROAD MARKING APPARATUS AND METHOD

BACKGROUND OF THE INVENTION

This invention relates to an improved apparatus for heating traffic paint which is to be applied to a road surface at elevated temperatures, and to a method for heating and applying such paint. There have been several proposals for providing heat to traffic paint compositions prior to application to a road surface, as evidenced by the following U.S. Pat. Nos.: 2,980,339; 2,134,799; 2,903,189; 3,092,325 and 3,802,396. Of particular interest is U.S. Pat. No. 3,092,325 to Brown, et al. in 1963 which describes a heating device and heat exchanger in order to maintain a uniform paint viscosity through the ambient temperature variations encountered during a typical day or road marking and striping and as an alternative to the addition and adjustment of the paint viscosity by addition of various supplementary solvents and thinners.

The advent of traffic paint, which was capable of drying to a track-free state within a period of time of 60 seconds or less, brought with it the requirement that these traffic paint formulations be applied at a temperature in the range of 120°-180° F., and usually towards the higher end of that range, i.e., 160°-180° F. To satisfy this requirement prior to the present invention it was customary to employ a heater which heated a high transfer liquid which, in turn, was supplied to a heat exchanger through which the paint is circulated and heated for spraying onto the road surface at the requisite temperature. Such heaters are separately powered and are usually fueled by propane gas or kerosene in much the same manner as is a household furnace. There are several disadvantages associated with the use of a heater and these include the energy costs and maintenance requirements of such heaters as well as introducing a flame source/fire hazard potential on a vehicle which carries potentially flammable traffic paint, gasoline and/or diesel fuel as well as other potentially combustible substances.

The present invention provides for the first time a practical means for collecting a substantial amount of heat generated by the road striping apparatus itself and using this recovered heat to increase the temperature of the traffic paint composition to a predetermined range before the paint is sprayed onto the road surface. Thus, the use of an independently powered heater and its attendant hazards and disadvantages is avoided. The present invention provides for the recovery and application of heat values that would otherwise be exhausted to otherwise dissipated.

A typical road striping truck or apparatus includes a motor driven chassis on which is mounted paint containers, an air compressor, paint spray guns, associated spray gun positioning apparatus and hoses and often retroreflective glass bead storage tanks and applicators. Heat sources on such vehicles, previously recognized, are the engine that powers the vehicle, or possibly are auxiliary internal combustion engine for powering the air compressor, and specifically the engine coolant that is circulated from the engine water jacket to a radiator and the engine exhaust line. What to my knowledge has now been appreciated or utilized in the art is the heat generated by the air compressor. Air compressors used on such equipment generate unexpected amounts of heat from the mechanical energy expended into the compression of air. As an example, on a typical road striping truck the hoses from the compressed air side of the compressor, that is the output, operate in the range of 400° F., even up to 500° F., and special precautions must be taken to protect the vehicle operator and service personnel from contacting these heated hoses.

According to my invention, use is made of the combination of three heat sources available on a road striping apparatus. These sources include: (1) hot coolant from the vehicle engine powering the truck, (2) hot exhaust gases emitted from the vehicle engine, and (3) the hot compressed air line, this heating being caused by the mechanical compression of air in the air compressor. Heat values from these three sources are brought together in a collector box, described in detail below, to heat a transfer liquid which, in turn, is brought in thermal contact with the quick-drying traffic paint composition to be sprayed on the road surface. This arrangement provides for the first time an effective and reliable means for heating substantial amounts of quick-drying traffic paint to a temperature in the range of 120° F. to 180° F., and particularly to a temperature in the range of about 160° F. to 180° F.

The volume of traffic paint to be heated to the required value is dependent on several factors including the number of paint spray heads in operation, the width of the traffic line or lines applied, the thickness of the lines applied and the forward speed of the vehicle as it travels down the pavement to be marked. On a highway marking vehicle it is not unusual to have as many as 4 paint spray heads operating simultaneously, although some may be intermittent in operation to provide a dashed line. My system is designed to supply the total heat requirements for the volume of traffic paint composition being applied at the critical temperature range, and to provide sufficient heat for two color systems, typically white and yellow, that are used in several states. As the total heat requirements are provided by existing equipment on the vehicle the need for a traffic paint heater is eliminated thus avoiding a source of combustion.

The invention will be further described by reference to the attached drawing which is a schematic representation of the system and its operation.

In the FIGURE the heat source collection box, generally designated as 2, is supplied with heat values from three different sources. Coolant from engine 4 is conducted via line 6 to the lower portion of the collector 2 and pumped by the engine through the collector 2 via line 8 to a tube and shell heat exchanger 10 and returned via line 12 to the engine 4. The engine thermostat 14 directs the coolant along this circuit until a predetermined temperature is reached, say 205° F., then the coolant is at least partially circulated through the engine radiator 16 and returned.

Engine exhaust is directed via exhaust line 20 to a tee and fed to two parallel circuits. The lower circuit is supplied to a manifold 22, directed through several finned tubes 23 passing from one end of the collector box to the other to manifold 26. The exhaust gases are then directed via line 28 to a by-pass valve 30 and exhausted out muffler 32. However, if the temperature in the collector 2 exceeds a predetermined value, thermostat 34 causes valve 30 to close and the exhaust gases by-pass the collector 2 via line 36 and are exhausted directly through muffler 32.

The third source of heat is air compressor 40 which sends hot compressed air via line 42 to a U-shaped finned tube 44 in collector 2. The cooled, compressed air issuing from the collector is then used at various points on the vehicle (not shown) including spray gun 46.

An efficient heat transfer liquid, preferably a mixture of glycol and water, is contained in collector 2 and is used as the coolant for engine 4 as well. After being heated to the required temperature the heat transfer liquid is directed to heat exchanger 10. A preferred heat exchanger is the shell and tube type available from various commercial sources. When two colors of paint are to be heated and applied two heat exchangers are used. Traffic paint is supplied from tank 48 on the vehicle at ambient temperature to heat exchanger 10 where it is brought into thermal contact with the circulating heat transfer liquid. The traffic paint composition is brought up to the desired temperature of at least 120° F. or higher, and sprayed with compressed air out of the spray gun 46 and onto the pavement surface. Depending upon the paint composition and temperatures achieved, the paint will dry rapidly.

While the above describes those aspects of the present invention of significance, it will be appreciated that various design changes and structural modifications may be made without departing from the spirit and intent of the invention.

In another aspect, my invention includes a method of heating a quick drying paint composition to a temperature in the range of 120° F. to 180° F., and preferably about 160° F. to 180° F., using as the sole heat sources the engine coolant, engine exhaust and compressed air, as described in detail above. Such quick drying compositions were first made available in the late 1960's and are described in some detail in U.S. Pat. No. 3,474,057 to deVries, the disclosure of which is hereby incorporated by reference. While the patent describes various formulations and application conditions, preferred is a composition of the following general formula, expressed in percent by weight: A resin binder, such as short and medium oil length glycerol or other polyfunctional alcohol phthalic alkyds, from 12 to 22 percent; pigments and extenders such as titanium dioxide, silica, natural clays, tale and chrome yellow, from 50 to 69.4 percent; low boiling point solvents which have a boiling range below the temperature at which the paint composition is to be sprayed, having a relative high solvency for the resin binder, such as cyclohexane, chloroform, carbon tetrachloride, trichloroethylene, methyl ethyl ketone, benzene, and preferably methylene chloride, from 7 to 23 percent; and higher boiling point solvents, i.e., in the range of between 200° F. and 300° F., such as various aliphatic hydrocarbons, toluene and xylene, from 5 to 20 percent, together with suitable driers, additives and the like. Such compositions are maintained in a closed system and pumped under pressures of 100 to 150 psi, heated to a temperature of at least about 140° F., released and sprayed onto a roadway or similar surface wherein a very short time, say in 60 seconds or less, the compositions drys to a track-free state without being deformed or smeared by traffic passing over the thus applied material.

For rapid and effective drying to at least a no-track state within a period of 60 seconds or less an application temperature in the range of 160° F. to 180° F. is achieved from the three heat sources collected in the manner described above.

The actual heat values, measured in BTU's , obtained by my system is subject to several variables including the relative load placed on the engine for driving supplemental equipment such as the air compressor and hydraulic systems used on the vehicle, the forward speed of the vehicle and the amount of work expended to achieve that speed, as well as the ambient temperature at which the vehicle is operating.

What is claimed is:

1. Apparatus for spraying and heating a quick-drying traffic paint composition onto a road surface to a temperature of at least 120° F., said apparatus comprising:
   a vehicle driven by an internal combustion engine,
   an air compressor powered by said engine,
   a paint storage tank,
   a paint sprayer,
   heat collection means having an internal space for holding engine liquid including means for providing heated engine liquid to said internal space, a first set of tubes within and passing through said internal space in communication with and for passing hot engine exhaust gases through said internal space, said first set of tubes being in thermal contact with the liquid contained in said collection means, and a second set of tubes within and passing heated compressed air from said compressor in thermal contact with the liquid contained in said internal space; and
   a heat exchanger in fluid communication with said collection means and supplied with said heated liquid for heating traffic paint passed therethrough, traffic paint inlet means connected to said storage tank and paint outlet means connected to said paint sprayer, and inlet means for receiving the heated liquid from said collection means and outlet means for exhausting the liquid to said engine.

2. The apparatus as claimed in claim 1, wherein said first set of tubes has a plurality of heat-dissipating fins thereon.

3. The apparatus as claimed in claims 1 or 2, wherein said second set of tubes has a plurality of heat-dissipating fins thereon.

4. The apparatus as claimed in claim 1, further including a thermostat and radiator for said engine, the thermostat directing at least a portion of the engine liquid to the radiator at a predetermined temperature in excess of about 180° F.

5. The apparatus as claimed in claim 1, further including a by-pass circuit for the engine exhaust gases comprising a tee between the engine exhaust and said first set of tubes, a by-pass tubing connecting, together with the exhaust gases issuing from said heat collection means, to a valve means responsive to temperature conditions within said internal space, whereby when the temperature conditions within said internal space exceed a predetermined value hot exhaust gases from the engine are directed from the heat collection means.

6. Apparatus for spraying and heating a quick-drying traffic paint composition onto a road surface to a temperature of at least 120° F., said apparatus comprising:
   a vehicle driven by an internal combustion engine,
   an air compressor powered by said engine,
   a paint storage tank,
   a paint sprayer,
   heat collection means having an internal space for holding engine liquid including means for providing heated engine liquid to said internal space, a first set of tubes within and passing through said internal space in communication with and for passing hot engine exhaust gases through said internal space, said first set of tubes being in thermal contact with the liquid contained in said collection means, and a second set of tubes within and passing heated compressed air from said compressor in terminal contact with the liquid contained in said internal space;

a heat exchanger in fluid communication with said collection means and supplied with said heated liquid for heating traffic paint passed therethrough, traffic paint inlet means connected to said storage tank and paint outlet means connected to said paint sprayer, and inlet means for receiving the heated liquid from said collection means and outlet means for exhausting the liquid to said engine; and a temperature regulation means for maintaining the temperature of the heated engine liquid below a predetermined value including engine exhaust by-pass tubing and valve means between said tubing and the engine exhaust gases issuing from said first set of tubes, said valve means directing the engine exhaust gases through said by-pass tubing when a predetermined temperature is reached in said heated engine liquid within said internal space.

7. The apparatus as claimed in claim 6, further including an engine thermostat and a radiator both in fluid communication with said heated engine liquid, the thermostate directing at least a portion of the heated engine liquid to the radiator at a temperature in excess of about 180° F.

* * * * *